US007372204B2

(12) United States Patent
Kwon et al.

(10) Patent No.: US 7,372,204 B2
(45) Date of Patent: May 13, 2008

(54) PLASMA DISPLAY PANEL HAVING IGNITER ELECTRODES

(75) Inventors: Jae-Ik Kwon, Asan-si (KR); Kyoung-Doo Kang, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 571 days.

(21) Appl. No.: 10/913,484

(22) Filed: Aug. 9, 2004

(65) Prior Publication Data

US 2005/0029946 A1 Feb. 10, 2005

(30) Foreign Application Priority Data

Aug. 7, 2003 (KR) ..... 10-2003-0054654
Apr. 20, 2004 (KR) ..... 10-2004-0026982

(51) Int. Cl.
*H01J 17/49* (2006.01)

(52) U.S. Cl. ..... 313/583; 313/584

(58) Field of Classification Search ..... None
See application file for complete search history.

(56) References Cited

U.S. PATENT DOCUMENTS 4,783,651 A * 11/1988 Fischer et al. ..... 345/71
6,531,819 B1 * 3/2003 Nakahara et al. ..... 313/584
6,744,202 B2 * 6/2004 Okigawa et al. ..... 313/586
6,794,819 B2 * 9/2004 Kao et al. ..... 313/582
7,045,962 B1 * 5/2006 Murai et al. ..... 313/582
7,081,706 B2 * 7/2006 Huang et al. ..... 313/583
7,154,221 B2 * 12/2006 Son et al. ..... 313/582
2005/0052136 A1 * 3/2005 Kwon et al. ..... 313/584
2005/0258752 A1 * 11/2005 Kang ..... 313/584

FOREIGN PATENT DOCUMENTS

KR 1020000025736 5/2000
KR 1020000057765 9/2000

* cited by examiner

*Primary Examiner*—Nimeshkumar D. Patel
*Assistant Examiner*—Peter Macchiarolo
(74) *Attorney, Agent, or Firm*—H.C. Park & Associates, PLLC

(57) ABSTRACT

A plasma display panel, and particularly to a surface-discharge plasma display panel that may have an electrode structure in which a pair of discharge sustain electrodes may be arranged at respective discharge cells between two substrates to make the display discharge. The plasma display panel may include igniter electrodes formed over barrier ribs extending from discharge sustain electrodes along the barrier ribs, and protruding toward the inside of discharge cells at their ends.

21 Claims, 17 Drawing Sheets

PLASMA DISPLAY PANEL HAVING IGNITER ELECTRODES

CROSS-REFERENCE TO RELATED APPLICATION

The present application claims the benefit of Korean Patent Application No. 2003-0054654 filed Aug. 7, 2003, hereby incorporated fully by reference, and of Korean Patent Application No. 2004-0026982 filed Apr. 20, 2004, hereby also incorporated fully by reference.

BACKGROUND OF THE INVENTION (a) Field of the Invention

The present invention may relate to a plasma display panel, and particularly to a surface-discharge plasma display panel that may have an electrode structure in which a pair of discharge sustain electrodes may be arranged at respective discharge cells between two substrates to make the display discharge.

(b) Description of Related Art

Generally, a plasma display panel (PDP) may be a display device that operates by exciting phosphors using ultraviolet rays radiated from plasma obtained by discharging an electric current through a gas. The desired result may be red (R), green (G), and blue (B) visible light that may be used to display a desired image. A PDP may be useful as a flat panel display for television and other displays, and may accrue several advantages. For example, a PDP may be able to provide a very large screen of 60" or more with a thickness of 10" or less. It may also have excellent color quality and may avoid image distortion due to change in viewing angle because it is a light-emissive display. A PDP may be made in a simplified manner, compared to a liquid crystal display (LCD), and thus may lower the cost of producing a flat panel display.

FIG. 17 illustrates the structure of an exemplary alternating current (AC) PDP. Address electrodes 112 may be formed on a rear substrate 110 in a direction (in the y-axis direction of the drawing), and a dielectric layer 113 may be formed on the entire surface of the rear substrate 110 and may also cover the address electrodes 112. A plurality of stripe-shaped barrier ribs 115 may be formed on the dielectric layer 113 between the neighboring address electrodes 112. Red R, green G, and blue B phosphor layers 117 may be formed between the neighboring barrier ribs 115.

A pair of discharge sustain electrodes 102 and 103 may be formed on the surface of the front substrate 100 facing the rear substrate 110 in a direction crossing the address electrodes 112 (in the x-axis direction of the drawing). The pair of discharge sustain electrodes 102 and 103 may include transparent electrodes 102*a* and 103*a* as well as bus electrodes 102*b* and 103*b*. A dielectric layer 106 and an MgO protective layer 108 may be sequentially formed on the entire surface of the front substrate 100 and may also cover the discharge sustain electrodes 102 and 103.

The address electrodes 112 may be formed on the rear substrate 110, and the pair of discharge sustain electrodes 102 and 103 may be formed on the front substrate 100 such that the address electrodes 112 and the discharge sustain electrodes 102 and 103 cross each other. The area where they cross may be the discharge cells.

A plurality (for example, millions) of such discharge cells may be included in a matrix form within a PDP. In order to simultaneously drive the discharge cells of the AC PDP arranged in the matrix form, the memory characteristic thereof may be used.

A predetermined voltage may be made to generate the discharge between the X electrode (display electrode) 102 and the Y electrode (scan electrode) 103. The X electrode (display electrode) 102 and the Y electrode (scan electrode) 103 may be the pair of discharge sustain electrodes 102 and 103. The critical voltage of such a discharge may be the firing voltage Vf. The address voltage Va may be applied between the Y electrode 103 and the address electrode 112, and the discharge may occur forming plasma within the discharge cells. This may occur because the electrons and ions in the plasma shift toward the electrode with opposite polarity, thereby permitting the flow of electric current.

The dielectric layers 106 and 113 may be formed on the respective electrodes of the AC PDP. Most of the charge carriers (for example, electrons or ions) may be deposited on whichever of dielectric layers 106 and 113 has polarity opposite that of the charge carrier. The net potential (after this deposition) between the Y electrode 103 and the address electrode 112 may be smaller than the originally applied address voltage Va. Thus the discharge may weaken, and the address discharge may dissipate. In such a case, a relatively small amount of electrons may be deposited on the X electrode 102, and a relatively large amount of ions may be deposited on the Y electrode 103. The charges deposited on the dielectric layer 106 covering the X and Y electrodes 102 and 103 may be the wall charge Qw. The space voltage formed between the X and the Y electrodes 102 and 103 due to the wall charge Qw may be the wall voltage Vw.

Assume that a predetermined voltage being the discharge sustain voltage Vs may be applied between the X and the Y electrodes 102 and 103. In such a case, the sum Vs+Vw of the discharge sustain voltage Vs plus the wall voltage Vw may be higher than the firing voltage Vf. Accordingly a discharge may occur within the discharge cell, generating vacuum ultraviolet light (VUV). The VUV light may excite the relevant phosphors, and those phosphors may emit photons of visible light through the transparent front substrate.

However, if any address discharge is not made between the Y electrode 103 and the address electrode 102 (for example, the address voltage Va may be not applied thereto), no wall charge may be deposited between the X and Y electrodes 102 and 103. As a result, no wall voltage Vw may exist between the X and Y electrodes 102 and 103. In such a case, only the discharge sustain voltage Vs applied between the X and Y electrodes 102 and 103 may be made within the discharge cell. As the discharge sustain voltage Vs may be lower than the firing voltage Vf, no discharge may occur in the gas space between the X and Y electrodes 102 and 103.

With the above-structured PDP, several operational steps may be performed between the power inputting and the obtaining of the visible rays. The energy transformation efficiency of the PDP at the respective steps may be not good, and hence, the efficiency of the currently available PDP (the ratio of brightness to power consumption) may be lower than the CRT. For example, the PDP involves disadvantages of high power consumption and significant heat generation.

Particularly with the PDP having an High Definition grade high resolution region of 40" or more, it may be important to reduce the power consumption. In order to solve such a problem, it may be proposed to lower the discharge voltage through enhancing the electrode structure. For instance, Japanese patent publication No. 2002-008549 discloses a PDP in which the transparent electrode for the discharge sustain electrodes may be mesh-shaped with a plurality of opening portions. Japanese patent publication No. 2001-243883 discloses a PDP in which a pair of bus electrodes for the discharge sustain electrodes may be correspondingly provided at the respective discharge cells, and transparent electrodes may protrude from the bus electrodes inwardly and outwardly. However, with such techniques, the discharge voltage may be not sufficiently reduced, and hence, the problem of high power consumption may be not yet solved.

SUMMARY OF THE INVENTION

It may be an aspect of the present invention to provide a PDP in which a separate subsidiary electrode may be provided within the discharge cell to permit plasma discharge with a lower discharge voltage and to stabilize driving.

According to one embodiment of the present invention, the PDP may include first and second substrates facing each other, address electrodes formed on the second substrate, barrier ribs arranged between the first and the second substrates defining a plurality of discharge cells, phosphor layers made within each of the discharge cells, discharge sustain electrodes formed on the first substrate, and igniter electrodes formed over the barrier ribs extending from the discharge sustain electrodes along the barrier ribs, and protruding toward the inside of the discharge cells at their ends.

Each igniter electrode may extend from the discharge sustain electrode, and branched from the extension while being protruded toward the inside of the pair of discharge cell neighbors. At least one igniter electrode corresponds to each discharge cell.

A portion of the igniter electrode passing over the barrier rib may have higher resistance than a portion of the igniter electrode protruding toward the inside of the discharge cells.

The discharge sustain electrodes may be formed on the first substrate. The discharge sustain electrodes include bus electrodes in a direction intersecting the address electrodes such that each of the discharge cells in communication with a pair of the bus electrodes, and protrusion electrodes formed extending from the bus electrode within each of the discharge cells such that a pair of opposing protrusion electrodes may be formed in each of the discharge cells. The igniter electrodes may be formed over the barrier ribs extending from the bus electrodes along the barrier ribs, and protruding toward the inside of the discharge cells at their ends.

The protrusion electrodes may be transparent, or metallic. If the protrusion electrodes may be metallic, an opening may be formed in each center of the protrusion electrodes.

The igniter electrodes may have extensions extending from the bus electrodes along the barrier ribs that may be parallel to the address electrodes, and protrusions protruding from the ends of the extensions toward the inside of the discharge cells. The extensions may extend toward the center of the discharge cells with a length greater than the protrusion electrodes in a direction the address electrodes may be formed such that the protrusions may be placed between the pair of protrusion electrodes facing each other.

The extension may be formed to have higher resistance than the protrusion. For example, the extension may be formed by ITO electrode and the protrusion may be metallic electrode. A portion can be removed from the extension to increase resistance thereof.

The igniter electrodes may be alternately provided at the barrier ribs adjacent in a direction the bus electrodes may be formed. The igniter electrodes may be transparent or metallic.

With a PDP according to another embodiment of the present invention, the discharge sustain electrodes may have transparent electrodes extended in a direction intersecting the address electrodes such that each of the discharge cells in communication with a pair of the transparent electrodes, and bus electrodes formed along the one-sided periphery of the transparent electrodes. Igniter electrodes may be formed extending from the transparent electrodes along the barrier ribs, and protruding toward the inside of the discharge cells.

The igniter electrodes may extend from the portions of the transparent electrodes placed over the barrier ribs, and may protrude toward the inside of the discharge cells.

The igniter electrodes may extend from at least one of the pair of transparent electrodes facing each other. Furthermore, the igniter electrodes may be alternately provided at the barrier ribs adjacent in a direction the transparent electrodes may be formed.

BRIEF DESCRIPTION OF THE DRAWINGS

The above and other advantages of the present invention may be seen with even greater clarity in the embodiments described in detail and illustrated with reference to the accompanying drawings.

DETAILED DESCRIPTION OF SEVERAL EMBODIMENTS

Figure 1:
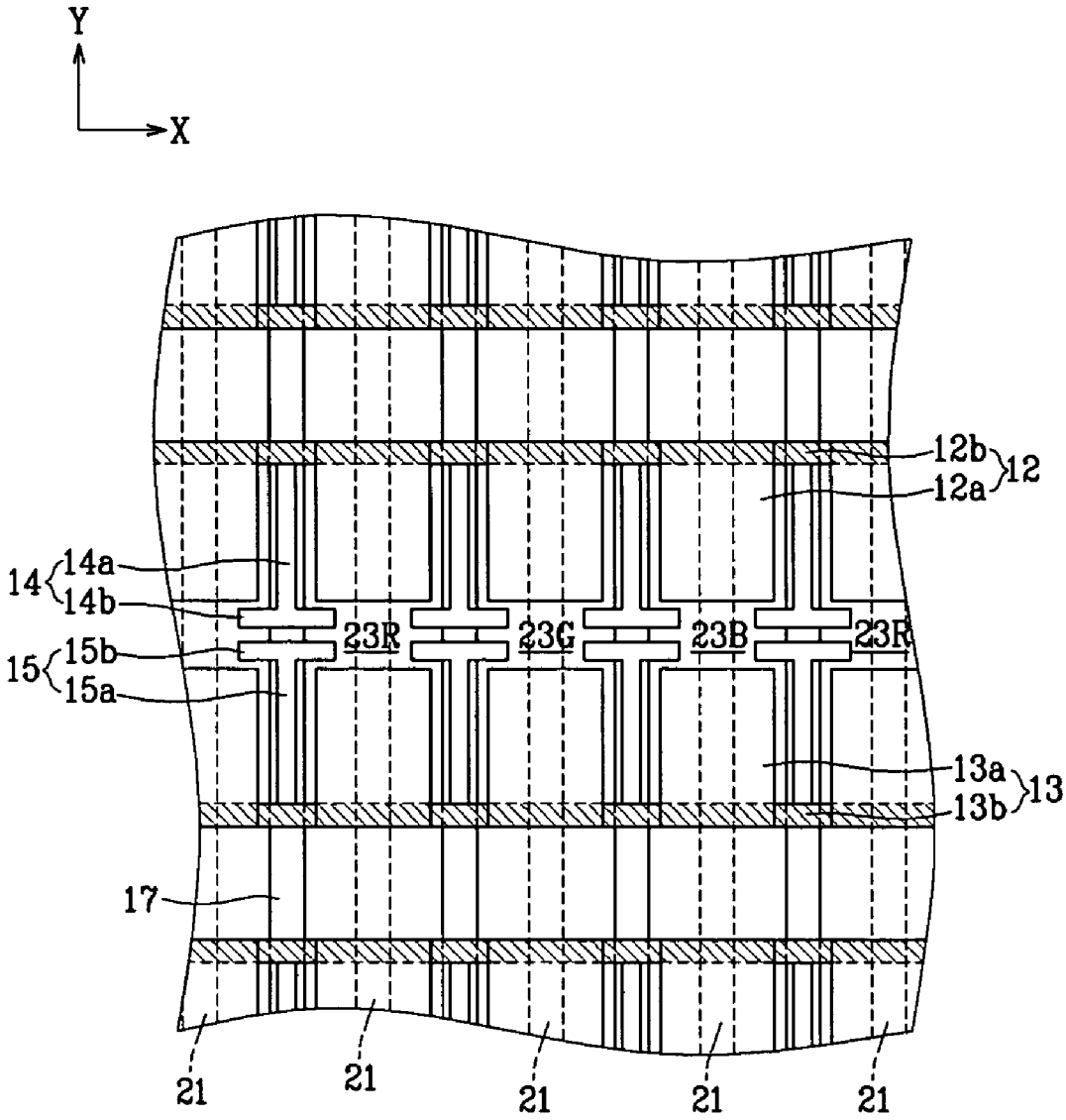
FIG. 1 is a partial plan view of a PDP according to a first embodiment of the present invention.

The present invention will be described more fully with reference to the accompanying drawings, in which several embodiments of the invention are shown. The drawings and embodiments described in detail are exemplary and are provided for purposes of illustration. Accordingly, the invention is not limited to the embodiments shown in the drawings.

FIG. 1 is a plan view of a PDP according to a first embodiment of the present invention.

A plasma display panel (PDP) according to the first embodiment may include a first substrate (not shown) and a second substrate (not shown) provided substantially in parallel with a predetermined gap therebetween. A plurality of discharge cells 23R, 23G, and 23B in which plasma discharge may take place may be defined by barrier ribs 17 between first substrate and second substrate. Discharge sustain electrodes 12 and 13 may be formed along one direction (x-axis direction of the drawings) on first substrate, and address electrodes 21 may be formed in a direction intersecting the discharge sustain electrodes 12 and 13 (y-axis direction of the drawings) on second substrate.

The barrier ribs 17 may be arranged between the neighboring address electrodes 21 and may be parallel to the address electrodes 21. Alternatively, a closed barrier rib structure with a barrier rib member that may be parallel to the address electrode 21 and a barrier rib member crossing the address electrode 21 may be provided to define the discharge cells 23R, 23G, and 23B.

The discharge sustain electrodes 12 and 13 may have protrusion electrodes 12*a* and 13*a*, and bus electrodes 12*b* and 13*b*. The protrusion electrodes 12*a* and 13*a* may have a function of making plasma discharge within the discharge cells 23R, 23G, and 23B. The protrusion electrodes 12*a* and 13*a* may be made of, for example, a transparent material, such as indium tin oxide (ITO), to obtain the desired brightness. The bus electrodes 12*b* and 13*b* may be made of a metallic material to compensate for the high resistance of the transparent protrusion electrodes 12*a* and 13*a*, and obtain the desired electrical conductivity. The discharge sustain electrodes 12 and 13 face each other in pairs. For example, a pair of bus electrodes 12*b* and 13*b* corresponding to respective discharge cells 23R, 23G, and 23B linearly extend parallel to each other, and protrusion electrodes 12*a* and 13*a* protruded from the respective bus electrodes 12*b* and 13*b* toward the inside of the respective discharge cells 23R, 23G, and 23B.

Meanwhile, igniter electrodes 14 and 15 may be connected to the bus electrodes 12*b* and 13*b*. The igniter electrodes 14 and 15 may extend from the bus electrodes 12*b* and 13*b*, and may protrude toward the inside of the discharge cells 23R, 23G, and 23B. The igniter electrodes 14 and 15 may have extensions 14*a* and 15*a* formed over the barrier ribs 17 extending from the bus electrodes 12*b* and 13*b* along the barrier rib 17 that may be parallel to the address electrode 21, and protrusions 14*b* and 15*b* protruded from the ends of the extensions 14*a* and 15*a* toward the inside of the discharge cells 23R, 23G, and 23B. The extensions 14*a* and 15*a* may extend toward the center of the discharge cells 23R, 23G, and 23B in the direction of the address electrode 21 such that they may be longer than the protrusion electrodes 12*a* and 13*a*. The protrusions 14*b* and 15*b* may be arranged between the pair of protrusion electrodes 12*a* and 13*a* facing each other.

In particular, the extensions 14*a* and 15*a* may be placed over the barrier rib 17 to confine the discharge current, thereby extending the life span of the electrode. The protrusions 14*b* and 15*b* may be branched from the ends of the extensions 14*a* and 15*a* toward the inside of the pair of discharge cell neighbors 23R, 23G, and 23B in the direction of the bus electrodes 12*b* and 13*b* to take the role of an igniter. In this embodiment, it may be illustrated that the extensions 14*a* and 15*a* and the protrusions 14*b* and 15*b* may be perpendicular to each other. Alternatively, the extensions 14*a* and 15*a* and the protrusions 14*b* and 15*b* may be angled to each other by more or less than 90°.

In this embodiment, the igniter electrodes 14 and 15 may extend from the pair of bus electrodes 12*b* and 13*b* facing each other in the direction of the bus electrodes 12*b* and 13*b* such that they may be arranged between the pair of discharge cell neighbors 23R, 23G, and 23B while facing each other. The igniter electrodes 14 and 15 may be made of a transparent material, and electrically connected to the bus electrodes 12*b* and 13*b*. Alternatively, the igniter electrodes 14 and 15 may be made of a metallic material.

The protrusions 14*b* and 15*b* of the igniter electrodes 14 and 15 may be directed toward the main discharge region between the discharge sustain electrodes 12 and 13 so that the discharge gap thereof can be shorter than the main discharge gap of the discharge sustain electrodes 12 and 13. Consequently, the discharge firing voltage Vf between the pair of discharge sustain electrodes 12 and 13 facing each other (for example, the scan electrode 13 and the sustain electrode 12) can be reduced, thereby obtaining stability in the sustain discharge. For example, the space charges formed by the discharge between the igniter electrodes 14 and 15 may be used in the relatively long-gapped main discharge region to fire the discharge so that the low voltage driving can be made, and the discharge efficiency through the long gap can be enhanced.

Figure 2:
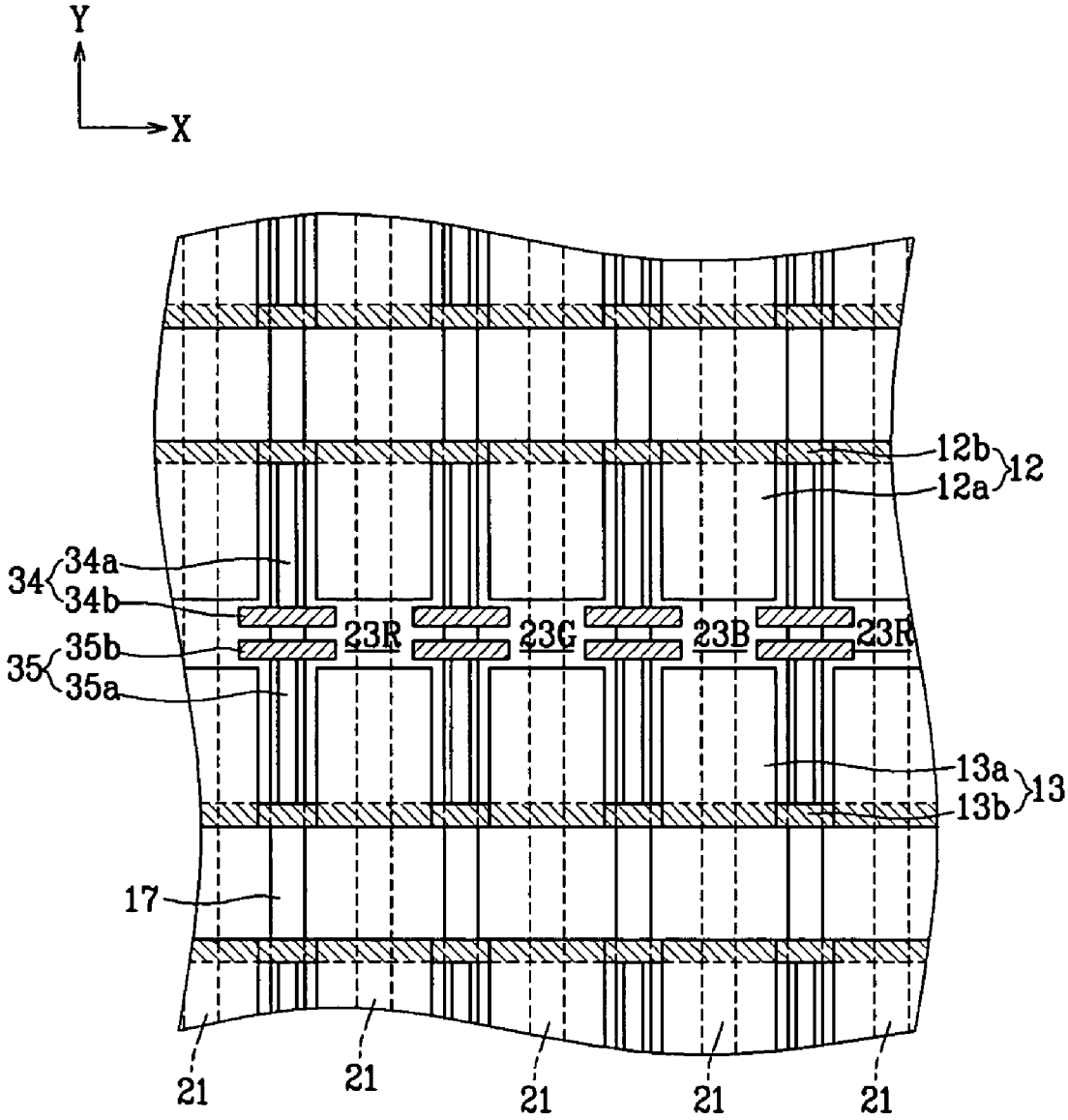
FIG. 2 is a partial plan view of a modified example of PDP of FIG. 1.

FIG. 2 is a partial plan view of a modified example of PDP of FIG. 1.

Igniter electrodes 34 and 35 according to this modified example of PDP may have extensions 34*a* and 35*a* that may have higher resistance than protrusions 34*b* and 35*b*. Before the discharge starts in discharge cell 23R, 23G, and 23B, a voltage may be applied to both ends between opposing igniter electrodes 34 and 35 or between igniter electrodes 34 and 35 and discharge sustain electrodes 12 and 13 without being affected by the resistance of the electrodes. However, once the discharge starts, discharge electric current passing through igniter electrodes 34 and 35 may be reduced rapidly due to the high resistance of extensions 34*a* and 35*a* of igniter electrodes 34 and 35. Power consumption may be generally defined by multiplying voltage by electric current. If the discharge electric current may be reduced as this example, power consumption can also be reduced and further the efficiency of the PDP can be improved.

The resistance of a part of extensions 34*a* and 35*a* may be higher than that of the protrusions 34*b* and 35*b*, or the overall resistance of the extensions 34*a* and 35*a* may be higher than that of the protrusions 34*b* and 35*b*.

The protrusions 34*b* and 35*b* of the igniter electrodes 34 and 35 may be formed by metallic electrodes having good conductivity, and also formed by the same material with the bus electrodes 12*b* and 13*b*. The extensions 34*a* and 35*a* of the igniter electrodes 34 and 35 may be formed by ITO electrodes having higher resistance than the metallic electrode.

Figure 3:
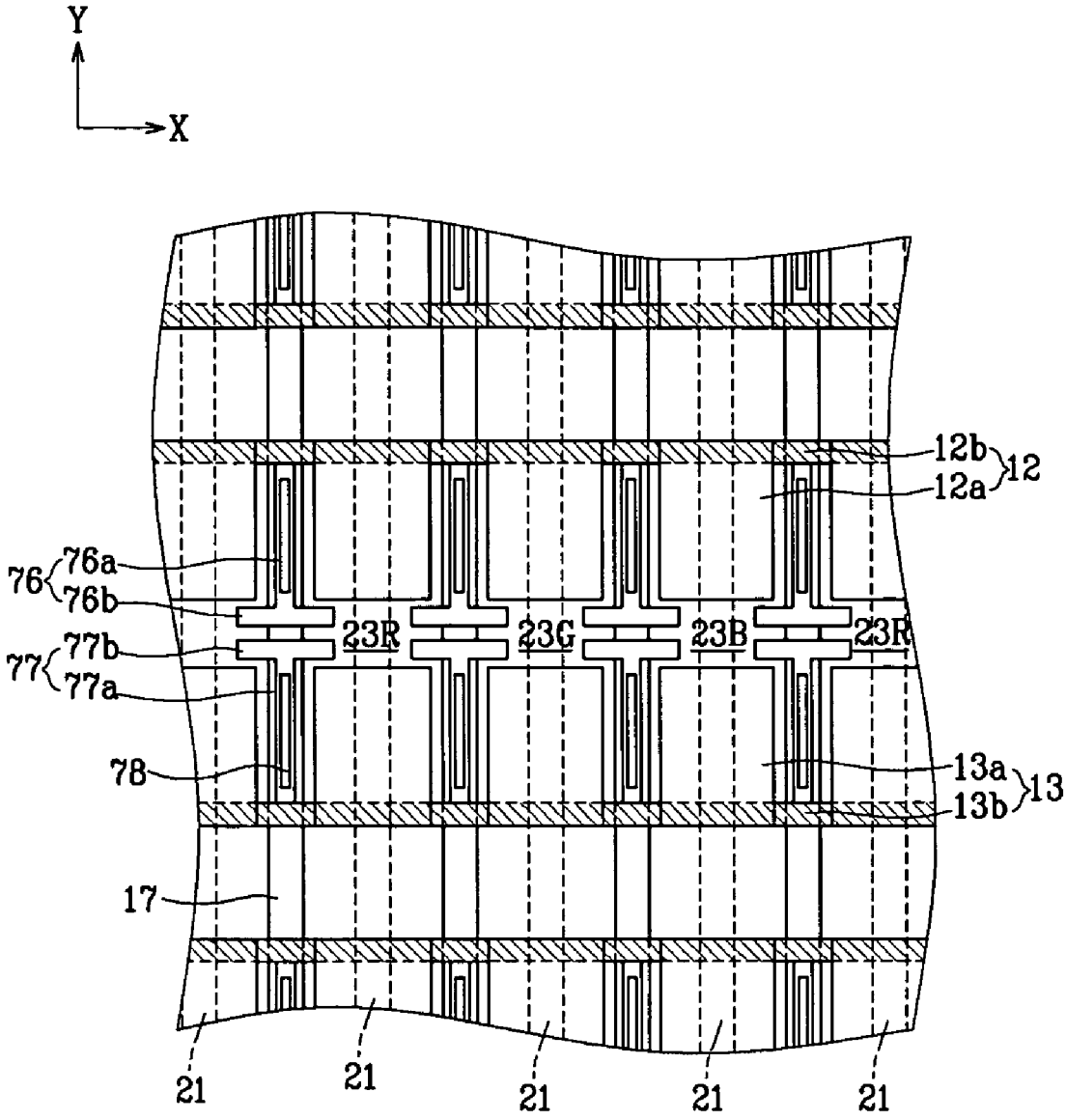
FIG. 3 is a partial plan view of another modified example of PDP of FIG. 1.

FIG. 3 is a partial plan view of another modified example of PDP of FIG. 1.

Igniter electrodes 76 and 77 according to this modified example of PDP may have extensions 76*a* and 77*a* that may have higher resistance than protrusions 34*b* and 35*b* by applying removed portion 78 thereto. As a result of high resistance of extensions 76*a* and 77*a*, discharge electric current can be reduced without any loss of discharge voltage. In such a case the extensions 76*a* and 77*a* can be formed by the same material with the protrusions 76*b* and 77*b*.

The PDPs according to a second embodiment, a third embodiment, and a fourth embodiment of the present invention may have the same basic structure as the PDP according to the first embodiment of the present invention, but may be differentiated from the latter in the arrangement structure of the igniter electrodes. The same reference numerals in the respective embodiments refer to the same components.

Figure 4:
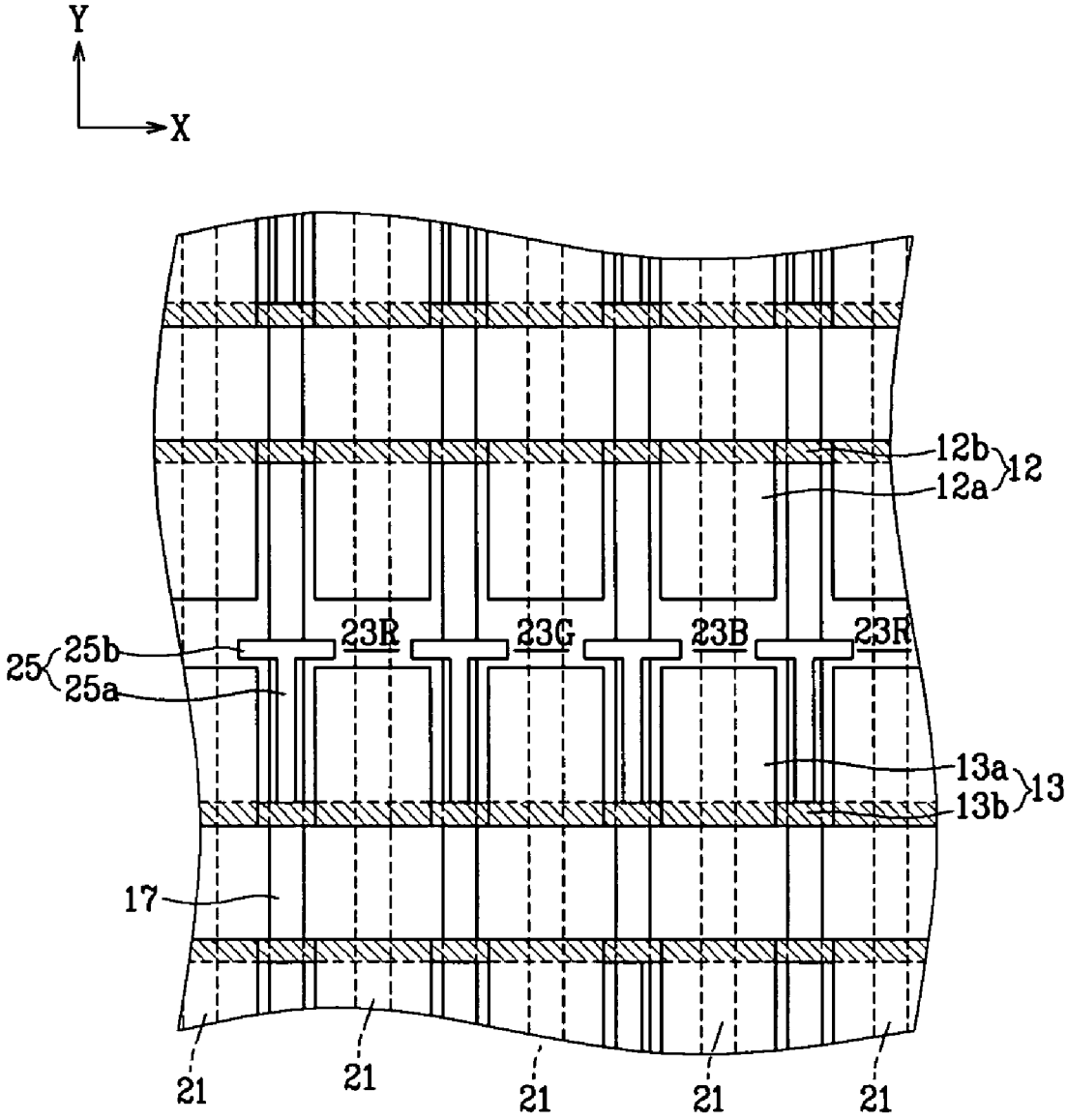
FIG. 4 is a partial plan view of a PDP according to a second embodiment of the present invention.

FIG. 4 is a partial plan view of a PDP according to a second embodiment of the present invention.

As shown in FIG. 4, an igniter electrode 25 may extend from the bus electrode 13*b* selected from the pair of bus electrodes 12*b* and 13*b* facing each other, and may protrude toward the inside of the respective discharge cells 23R, 23G, and 23B. For example, the igniter electrode 25 may have an extension 25*a* extending from the bus electrode 13*b* along the barrier rib 17 that may be parallel to the address electrode 21 while being placed over the barrier rib 17, and a protrusion 25*b* branched from the end of the extension 25*a*, and protruded toward the inside of the discharge cells 23R, 23G, and 23B. The bus electrode 13*b* connected to the igniter electrode 25 may function as a scan electrode or a sustain electrode.

Figure 5:
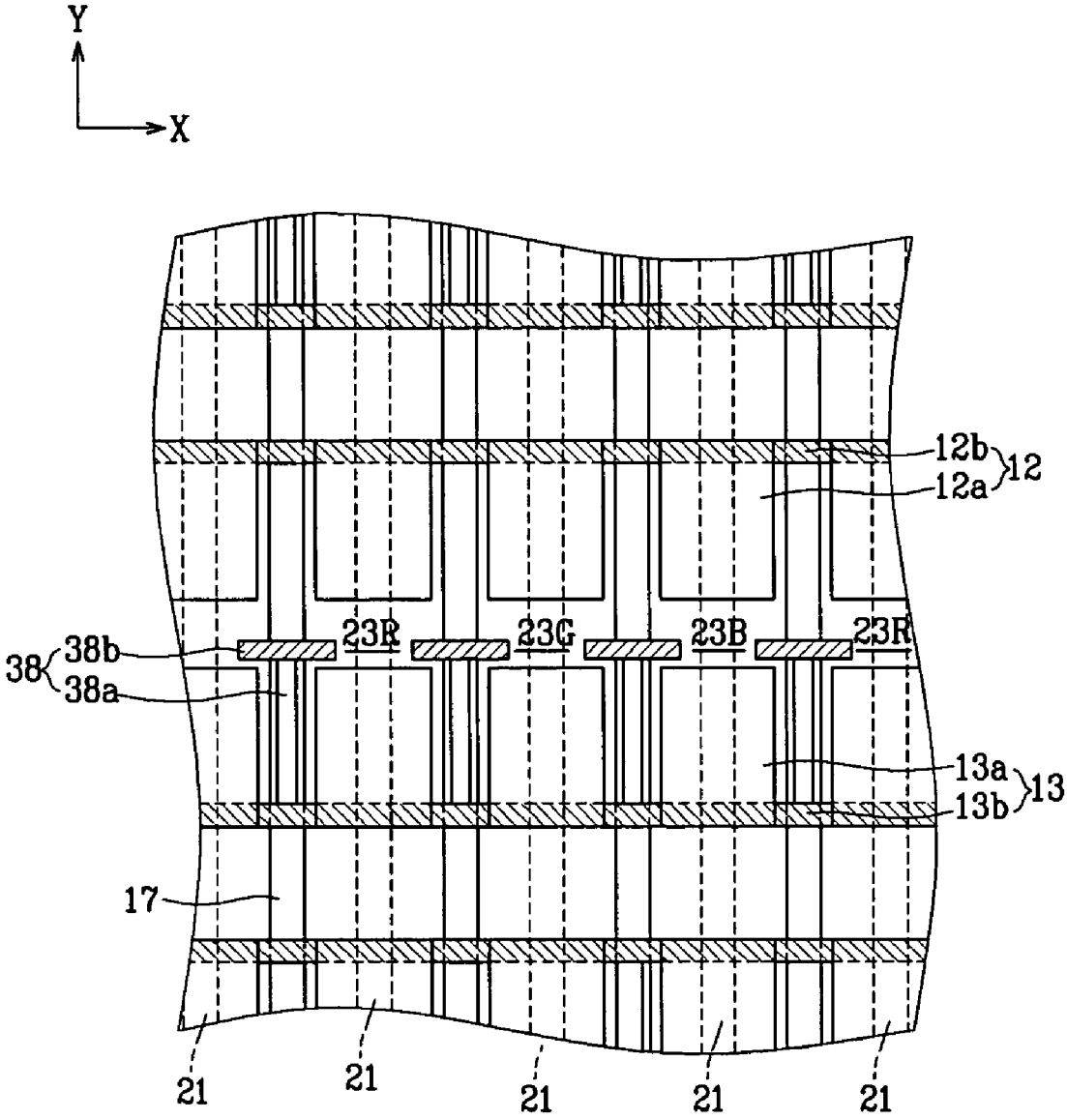
FIG. 5 is a partial plan view of a modified example of PDP of FIG. 4.

FIG. 5 is a partial plan view of a modified example of PDP of FIG. 4.

Igniter electrode 38 according to this modified example of PDP may have extension 38*a* that may have higher resistance than protrusion 38*b*. The protrusion 38*b* of the igniter electrode 38 may be formed by metallic electrodes having good conductivity, and also formed by the same material with the bus electrodes 12*b* and 13*b*. The extension 38*a* of the igniter electrode 38 may be formed by ITO electrodes having higher resistance than the metallic electrode.

Figure 6:
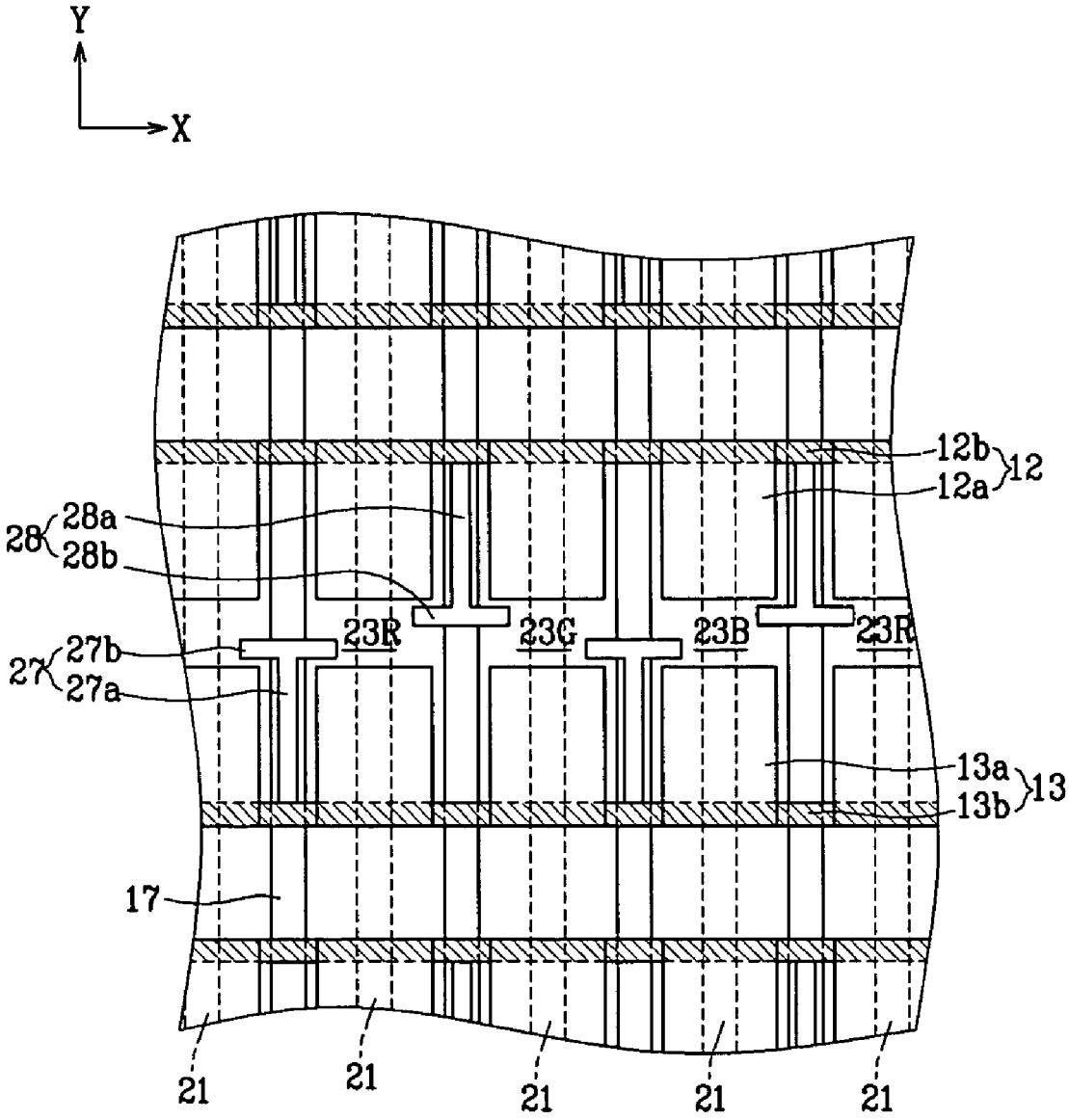
FIG. 6 is a partial plan view of a PDP according to a third embodiment of the present invention.

FIG. 6 is a partial plan view of a PDP according to a third embodiment of the present invention.

As shown in FIG. 6, igniter electrodes 27 and 28 may be alternately connected to one of a pair of bus electrodes 12*b* and 13*b* facing each other. Additionally, the igniter electrodes 27 and 28 may be alternately arranged per two barrier ribs 17 for forming the discharge cells 23R, 23G, and 23B, not per each barrier rib 17. The igniter electrodes 27 and 28 respectively connected to the bus electrodes 12*b* and 13*b* may not face each other, but may be spaced apart from each other. The igniter electrodes 27 and 28 may have extensions 27*a* and 28*a* extending from the respective bus electrodes 12*b* and 13*b* along the barrier ribs 17 that may be parallel to the address electrodes 21 while being placed over the barrier ribs 17, and protrusions 27*b* and 28*b* branched from the ends of the extensions 27*a* and 28*a*, and protruded toward the inside of the discharge cells 23R, 23G, and 23B.

Figure 7:
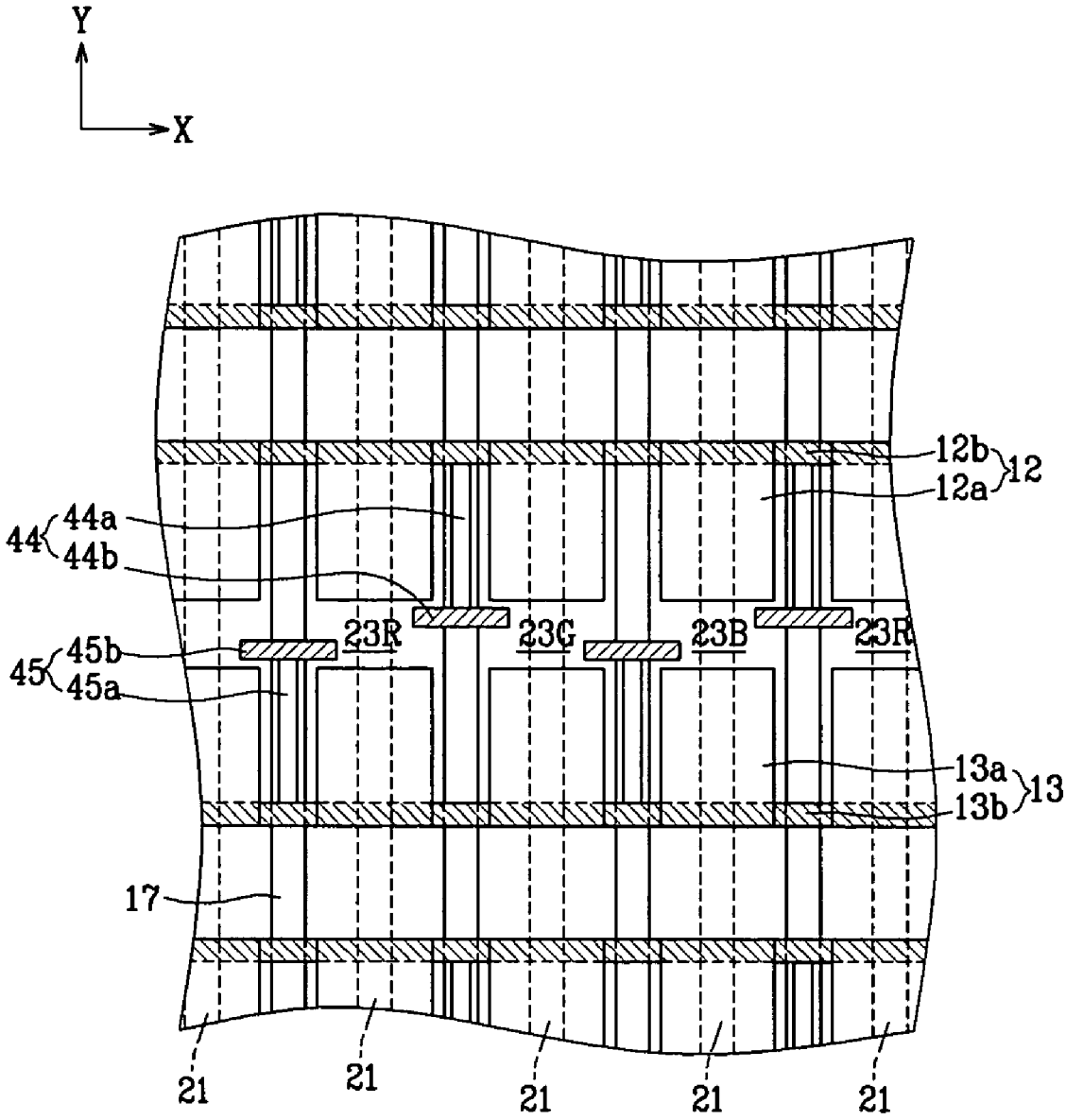
FIG. 7 is a partial plan view of a modified example of PDP of FIG. 6.

FIG. 7 is a partial plan view of a modified example of PDP of FIG. 6.

Igniter electrodes 44 and 45 according to this modified example of PDP may have extensions 44*a* and 45*a* that may have higher resistance than protrusions 44*b* and 45*b*. The protrusions 44*b* and 45*b* of the igniter electrodes 44 and 45 may be formed by metallic electrodes having good conductivity, and also formed by the same material with the bus electrodes 12*b* and 13*b*. The extensions 44*a* and 45*a* of the igniter electrodes 44 and 45 may be formed by ITO electrodes having higher resistance than the metallic electrode.

Figure 8:
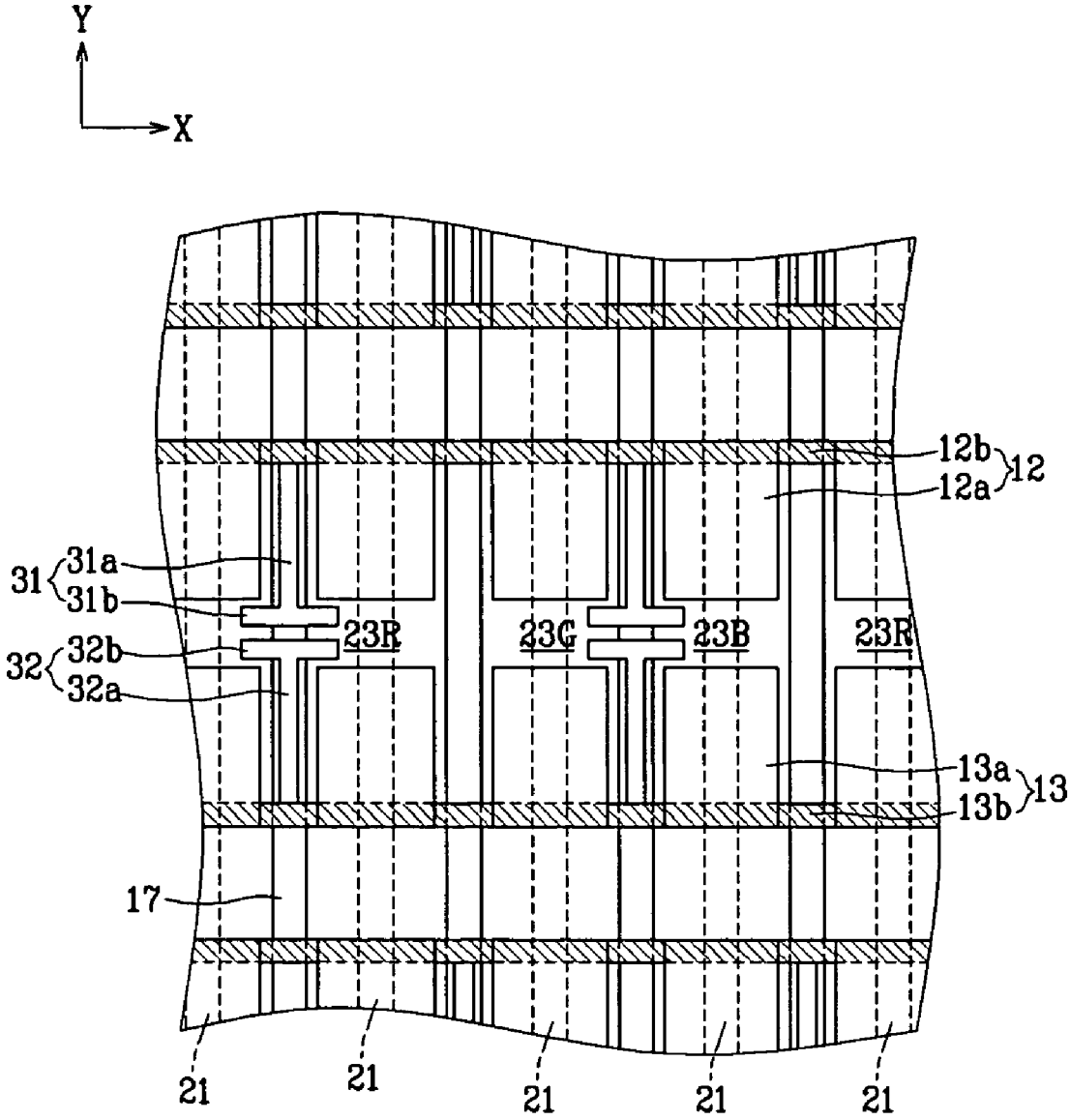
FIG. 8 is a partial plan view of a PDP according to a fourth embodiment of the present invention.

FIG. 8 is a partial plan view of a PDP according to a fourth embodiment of the present invention.

As shown in FIG. 8, igniter electrodes 31 and 32 may be alternately connected to a pair of bus electrodes 12*b* and 13*b* facing each other such that they may be periodically arranged per two barrier ribs 17 for forming the discharge cells 23R, 23G, and 23B, like the structure according to the third embodiment. However, in this embodiment, the igniter electrodes 31 and 32 connected to the bus electrodes 12*b* and 13*b* may be arranged in pairs while facing each other. The igniter electrodes 31 and 32 may have extensions 31*a* and 32*a* extending from the respective bus electrodes 12*b* and 13*b* along the barrier ribs 17 that may be parallel to the address electrodes 21 while being placed over the barrier ribs 17, and protrusions 31*b* and 32*b* branched from the ends of the extensions 31*a* and 32*a*, and protruded toward the inside of the discharge cells 23R, 23G, and 23B.

Figure 9:
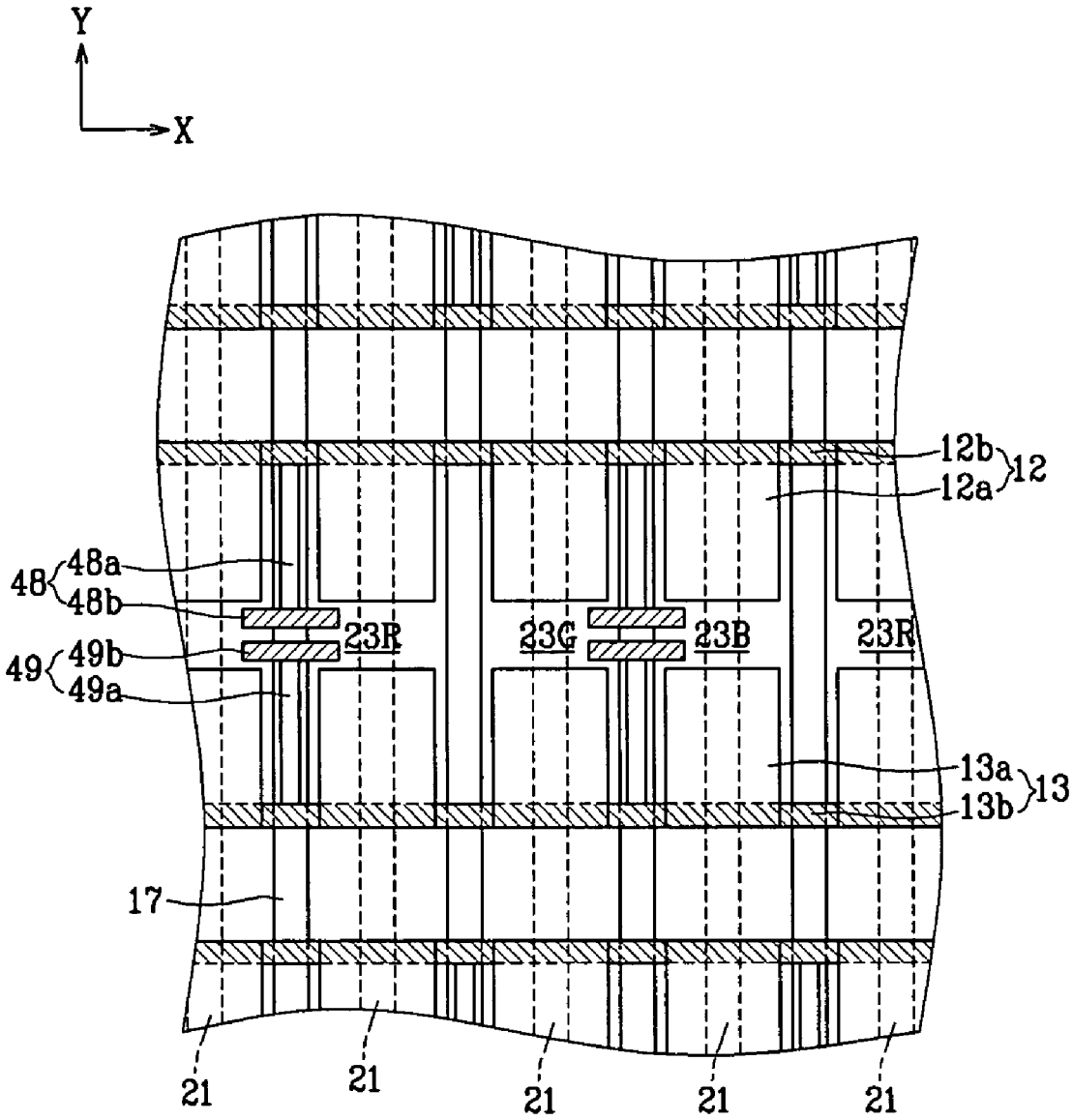
FIG. 9 is a partial plan view of a modified example of PDP of FIG. 8.

FIG. 9 is a partial plan view of a modified example of PDP of FIG. 8.

Igniter electrodes 48 and 49 according to this modified example of PDP may have extensions 48*a* and 49*a* that may have higher resistance than protrusions 48*b* and 49*b*. The protrusions 48*b* and 49*b* of the igniter electrodes 48 and 49 may be formed by metallic electrodes having good conductivity, and also formed by the same material with the bus electrodes 12*b* and 13*b*. The extensions 48*a* and 49*a* of the igniter electrodes 48 and 49 may be formed by ITO electrodes having higher resistance than the metallic electrode.

Figure 10:
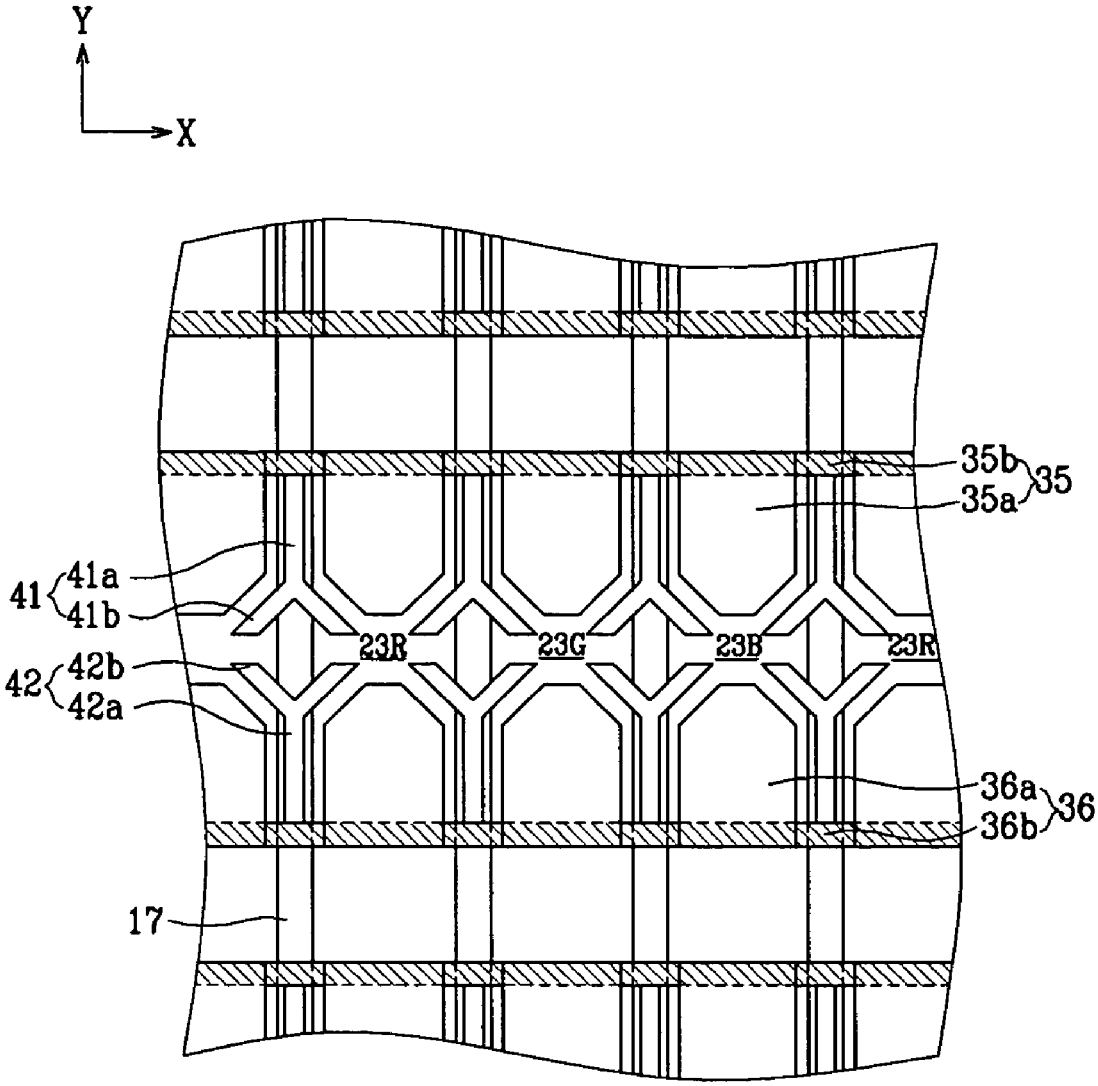
FIG. 10 is a partial plan view of a PDP according to a fifth embodiment of the present invention.

FIG. 10 is a partial plan view of a PDP according to a fifth embodiment of the present invention.

As shown in FIG. 10, discharge sustain electrodes 35 and 36 may have protrusion electrodes 35*a* and 36*a*, and bus electrodes 35*b* and 36*b*. The opposing edges of the respective protrusion electrodes 35*a* and 36*a* may be cut in a slant manner such that they may be wholly shaped like a pentagon. Igniter electrodes 41 and 42 may extend from the bus electrodes 35*b* and 36*b*, and may protrude toward the inside of the discharge cells 23R, 23G, and 23B. The igniter electrodes 41 and 42 may have extensions 41*a* and 42*a* extending from the bus electrodes 35*b* and 36*b* along the barrier rib 17 that may be parallel to the address electrodes 21 while being placed over the barrier rib 17, and protrusions 41*b* and 42*b* protruded from the ends of the extensions 41*a* and 42*a* toward the inside of the discharge cells 23R, 23G, and 23B. In such a case, the extensions 41*a* and 42*a* may not be longer than the protrusion electrodes 35*a* and 36*a*, and the protrusions 41*b* and 42*b* may protrude toward the center of the discharge cells 23R, 23G, and 23B and may be parallel to the inclined sides of the protrusion electrodes 35*a* and 36*a*.

As shown in FIG. 10, the pair of igniter electrodes 41 and 42 may be formed at the respective barrier ribs 17 for the respective discharge cells 23R, 23G, and 23B while facing each other. Alternatively, they may be made of the arrangement related to the second to fourth embodiments of the present invention.

Figure 11:
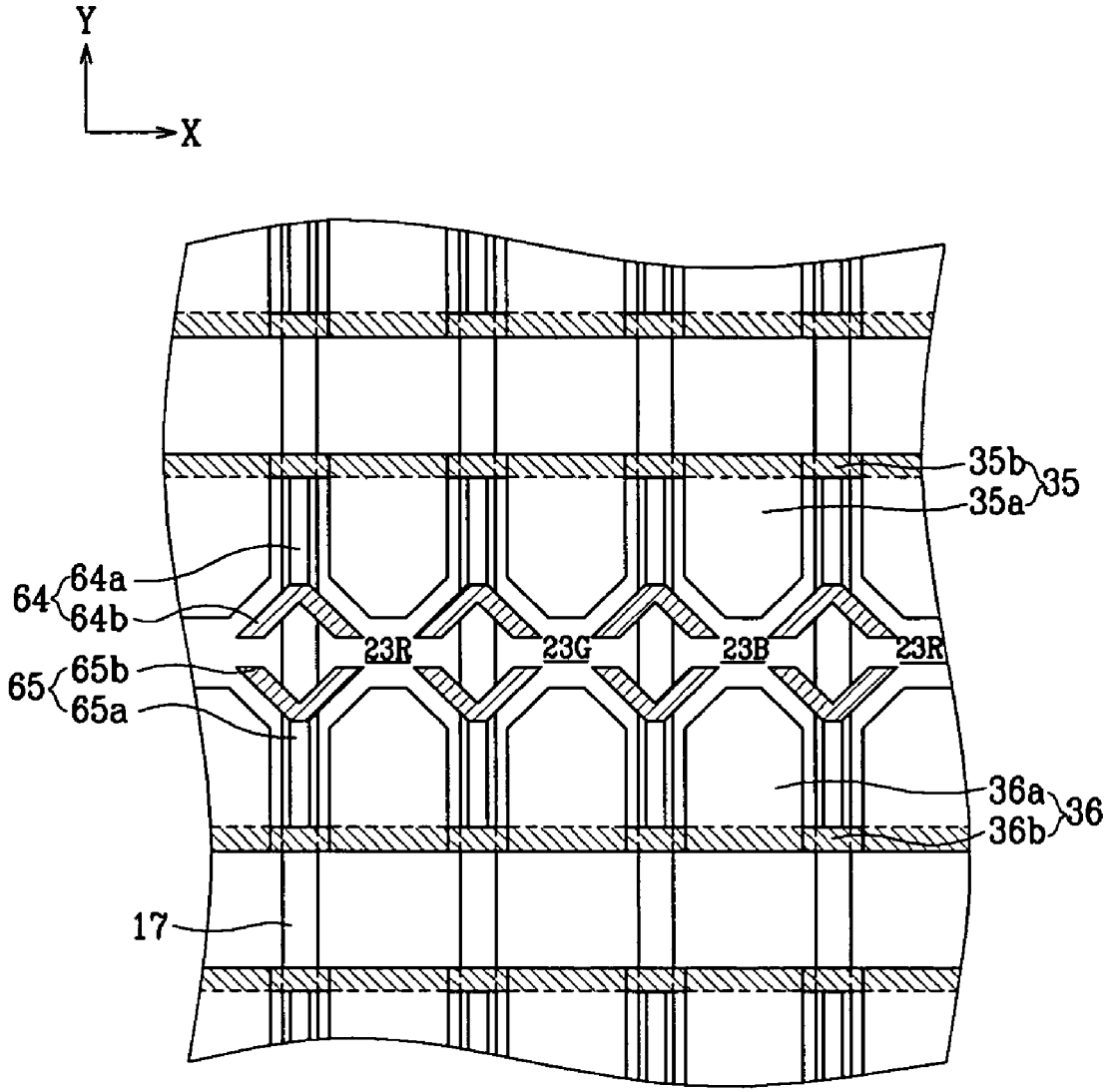
FIG. 11 is a partial plan view of a modified example of PDP of FIG. 10.

FIG. 11 is a partial plan view of a modified example of PDP of FIG. 10.

Igniter electrodes 64 and 65 according to this modified example of PDP may have extensions 64*a* and 65*a* that may have higher resistance than protrusions 64*b* and 65*b*. The protrusions 64*b* and 65*b* of the igniter electrodes 64 and 65 may be formed by metallic electrodes having good conductivity, and also formed by the same material with the bus electrodes 35*b* and 36*b*. The extensions 64*a* and 65*a* of the igniter electrodes 64 and 65 may be formed by ITO electrodes having higher resistance than the metallic electrode.

Figure 12:
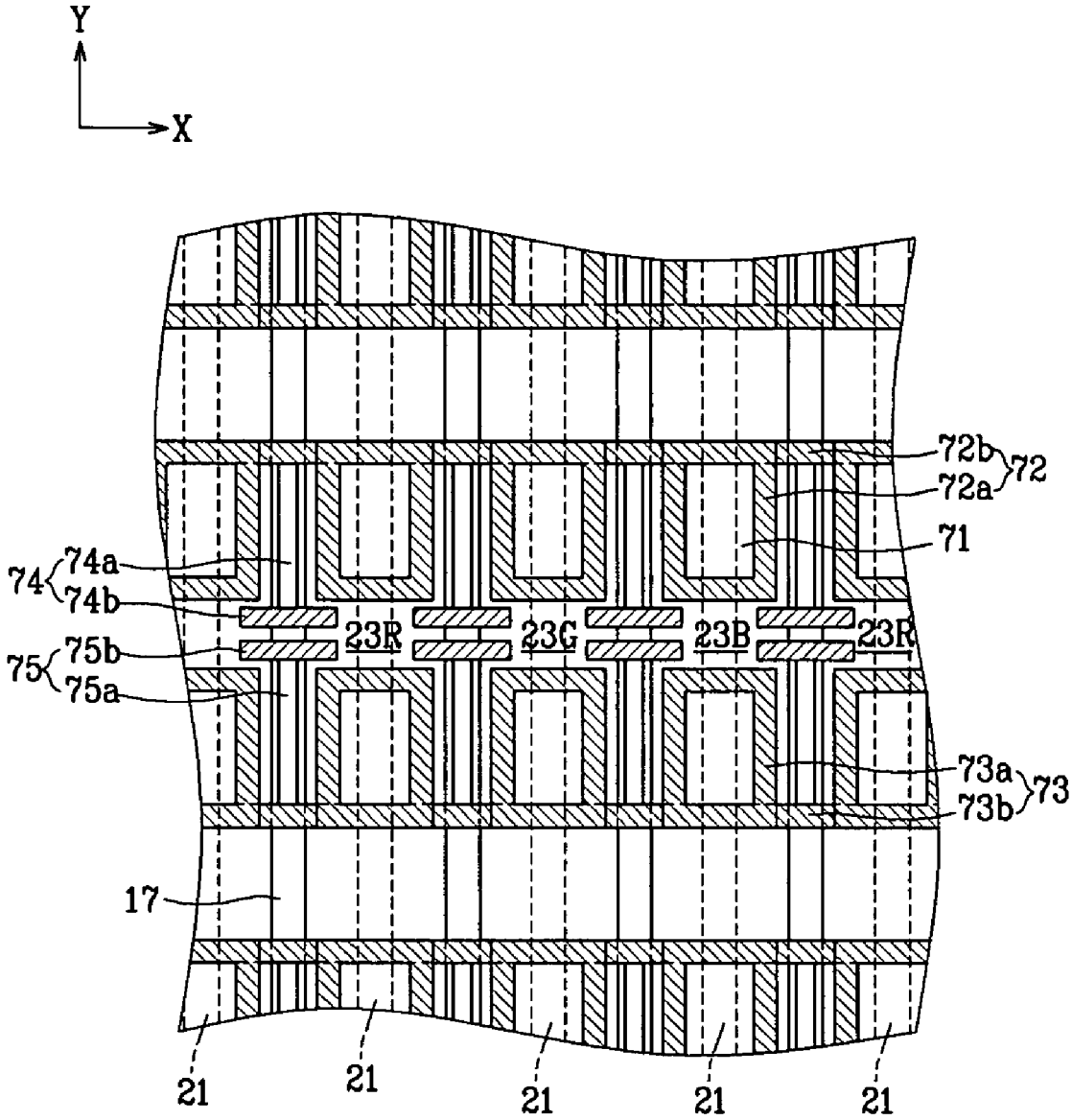
FIG. 12 is a partial plan view of a PDP according to a sixth embodiment of the present invention.

FIG. 12 is a partial plan view of a PDP according to a sixth embodiment of the present invention.

In this embodiment, protrusion electrodes 72*a* and 73*a* may be formed by metallic electrode instead of transparent electrodes. The metallic electrode may be opaque and may prevent the visible light generated within the discharge cells 23R, 23G, and 23B from emitting outwardly and thus decrease the aperture ratio of the display. Therefore, it may be desirable that an opening 71 may be formed in each center of the protrusion electrodes 72*a* and 73*a* in order to increase the aperture ratio of the display.

The igniter electrode arrangement of the first embodiment may be adopted for the igniter electrodes 74 and 75 of this embodiment. In addition, the igniter electrode arrangement of the second to forth embodiment may also be adopted, and the igniter electrode arrangement of the fifth embodiment can be adopted with the modification of the protrusion electrodes 72*a* and 73*a*.

PDPs according to seventh to tenth embodiments of the present invention will be now explained in detail.

With the PDPs according to the seventh to tenth embodiments, the discharge sustain electrodes 45 and 46 may have transparent electrodes 45*a* and 46*a* formed on a first substrate (not shown) at the respective discharge cells 23R, 23G, and 23B in pairs while extending in a direction (in the y-axis direction of the drawings) crossing the address electrodes (not shown), and bus electrodes 45*b* and 46*b* formed along a periphery of the transparent electrodes 45*a* and 46*a*.

Figure 13:
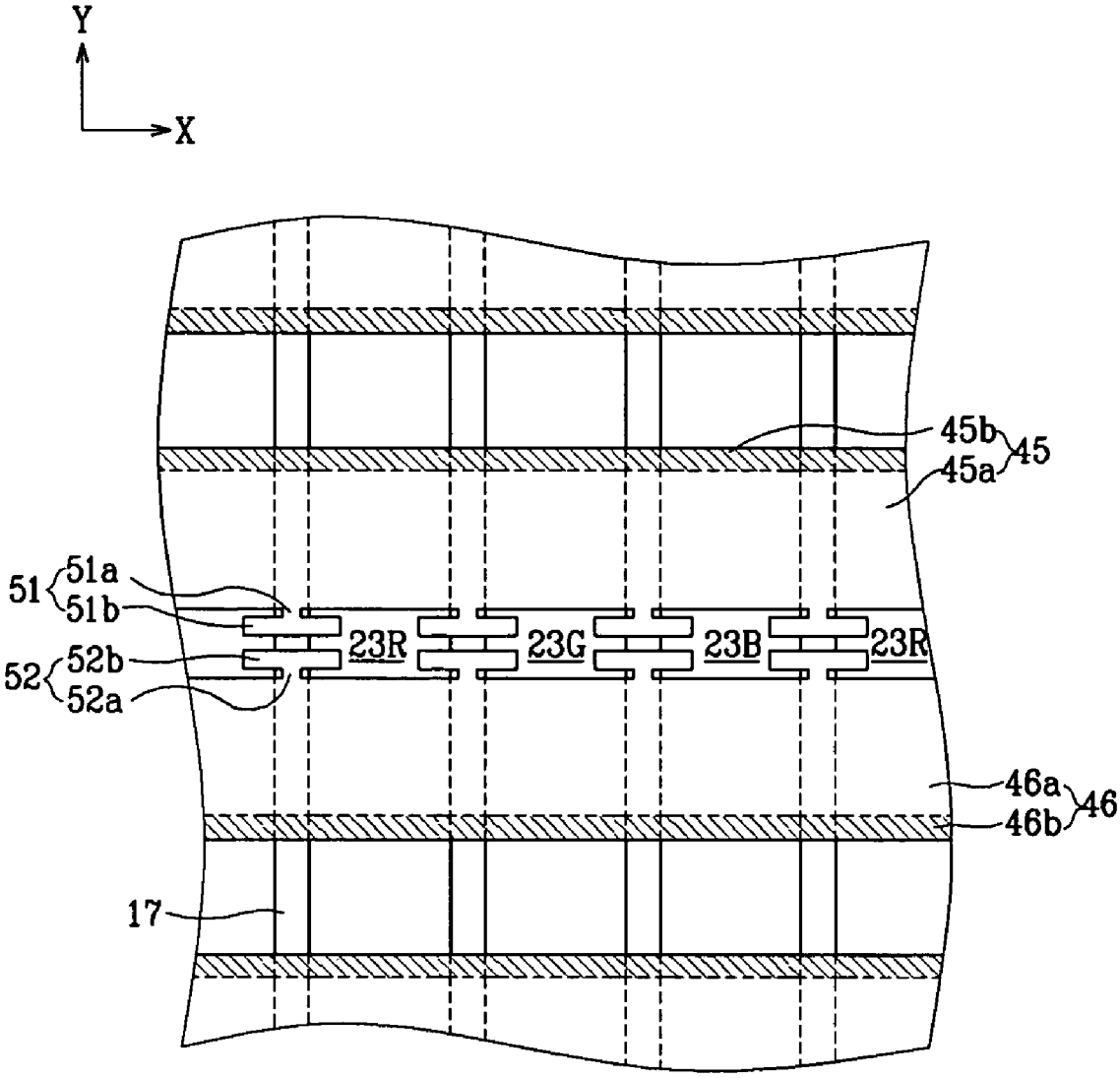
FIG. 13 is a partial plan view of a PDP according to a seventh embodiment of the present invention.

FIG. 13 is a partial plan view of a PDP according to a seventh embodiment of the present invention.

As shown in FIG. 13, igniter electrodes 51 and 52 may extend from the transparent electrodes 45*a* and 46*a*, and may protrude toward the inside of the discharge cells 23R, 23G, and 23B. Specifically, the igniter electrodes 51 and 52 may have extensions 51*a* and 52*a* extending from the portions of the transparent electrodes 45*a* and 46*a* placed over the barrier rib 17 along the barrier rib 17, and protrusions 51*b* and 52*b* branched from the ends of the extensions 51*a* and 52*a* to the inside of the pair of discharge cell neighbors in the direction of the bus electrodes 45*b* and 46*b*. The pair of igniter electrodes 51 and 52 may be arranged per the respective barrier ribs 17 for the respective discharge cells 23R, 23G, and 23B while facing each other.

Figure 14:
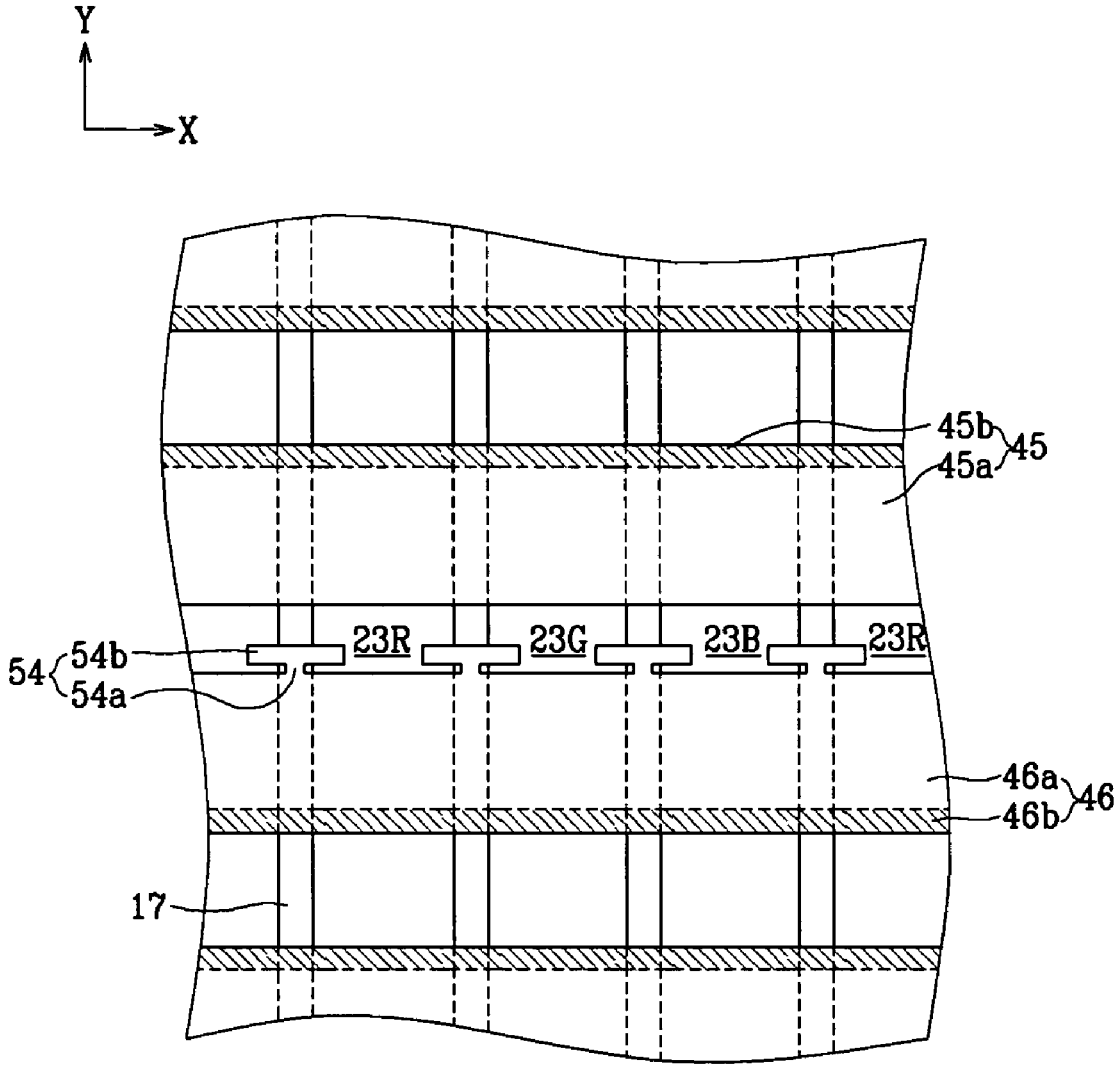
FIG. 14 is a partial plan view of a PDP according to an eighth embodiment of the present invention.

FIG. 14 is a partial plan view of a PDP according to a eighth embodiment of the present invention.

As shown in FIG. 14, an igniter electrode 54 may extend from the transparent electrode 46*a* selected from the pair of transparent electrodes 45*a* and 46*a* facing each other, and may protrude toward the inside of the respective discharge cells 23R, 23G, and 23B. For example, the igniter electrode 54 may have an extension 54*a* extending from the portion of the transparent electrode placed over the barrier rib 17 along the barrier rib 17, and a protrusion 54*b* branched from the end of the extension 54*a* and protruded toward the inside of the pair of discharge cell neighbors in the direction of the bus electrodes 45*b* and 46*b*. The igniter electrode 54 may be formed at the respective barrier ribs 17 for the respective discharge cells 23R, 23G, and 23B one by one. The transparent electrode 46*a* connected to the igniter electrode 54 may function as a scan electrode or a sustain electrode.

Figure 15:
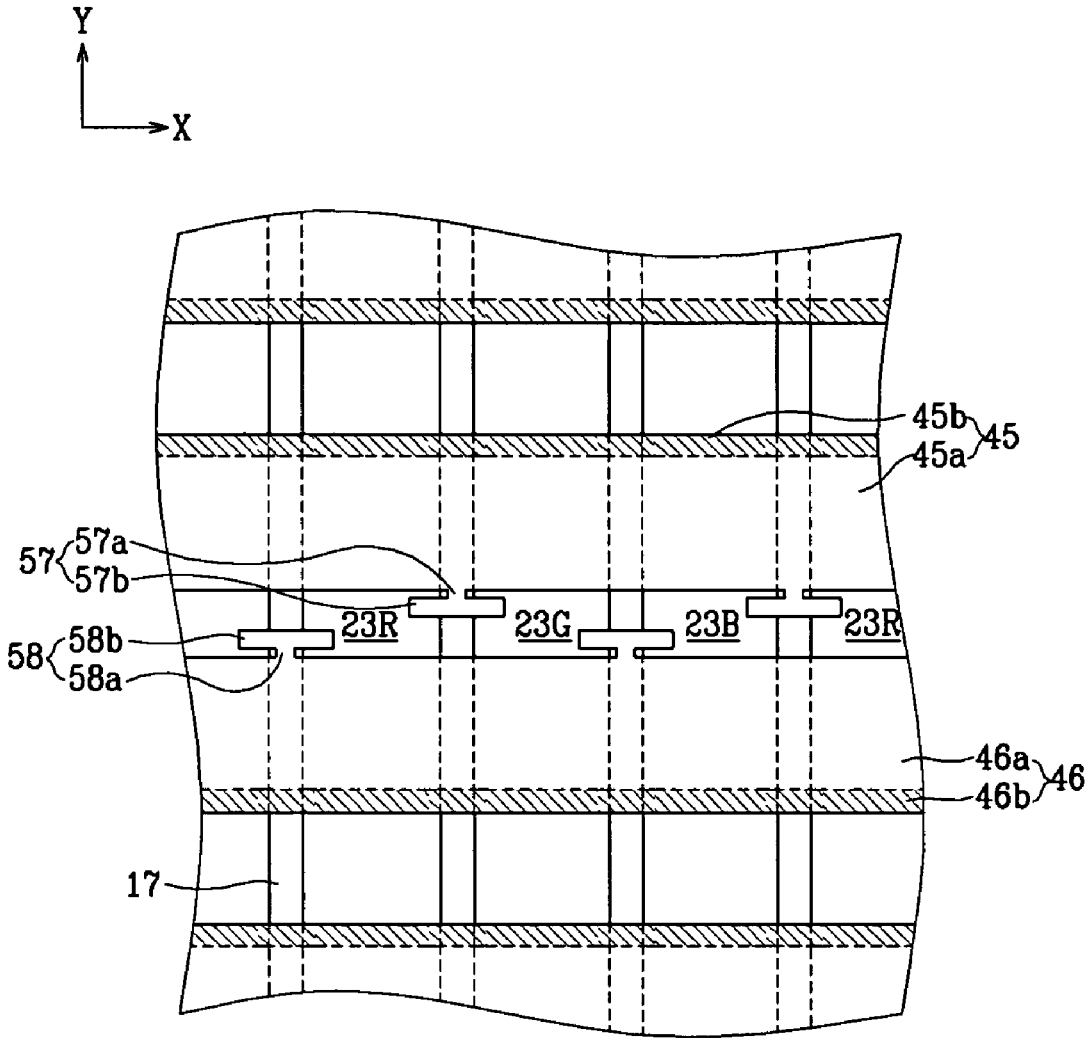
FIG. 15 is a partial plan view of a PDP according to a ninth embodiment of the present invention.

FIG. 15 is a partial plan view of a PDP according to a ninth embodiment of the present invention.

As shown in FIG. 15, igniter electrodes 57 and 58 may be alternately connected to one of the pair of transparent electrodes 45*a* and 46*a* facing each other. Additionally, the igniter electrodes 57 and 58 may be alternately arranged per two barrier ribs 17 for forming the discharge cells 23R, 23G, and 23B, not per each barrier rib 17. The igniter electrodes 57 and 58 respectivelv connected to the transparent electrodes 45*a* and 46*a* may not face each other, but may be spaced apart from each other. The igniter electrodes 57 and 58 may have extensions 57*a* and 58*a* extending from the portions of the transparent electrodes 45*a* and 46*a* placed over the barrier ribs 17 along the barrier ribs 17, and protrusions 57*b* and 58*b* branched from the ends of the extensions 57*a* and 58*a* and protruding toward the inside of the pair of discharge cell neighbors 23R, 23G, and 23B in the direction of the bus electrodes 45*b* and 46*b*.

Figure 16:
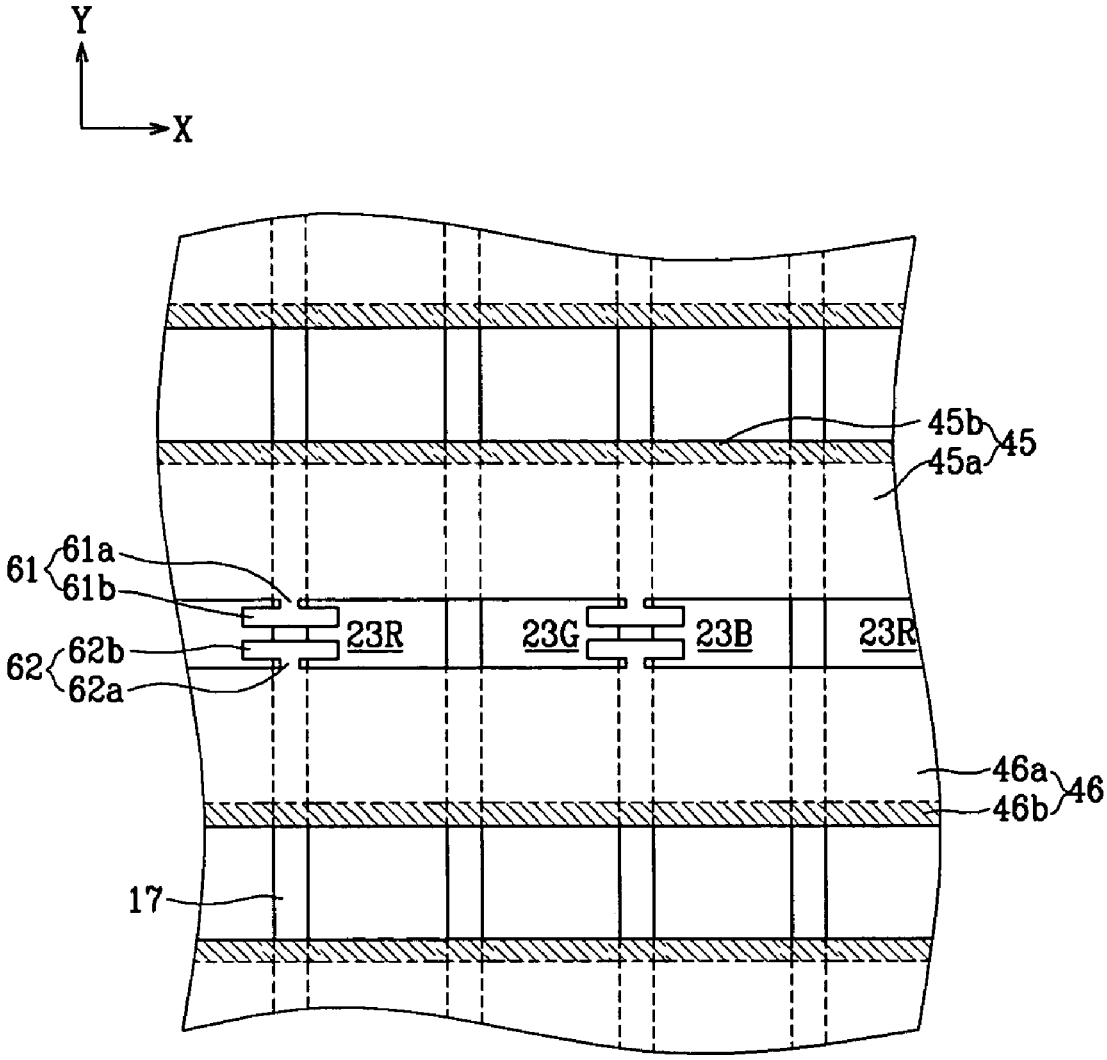
FIG. 16 is a partial plan view of a PDP according to a tenth embodiment of the present invention.
Figure 17:
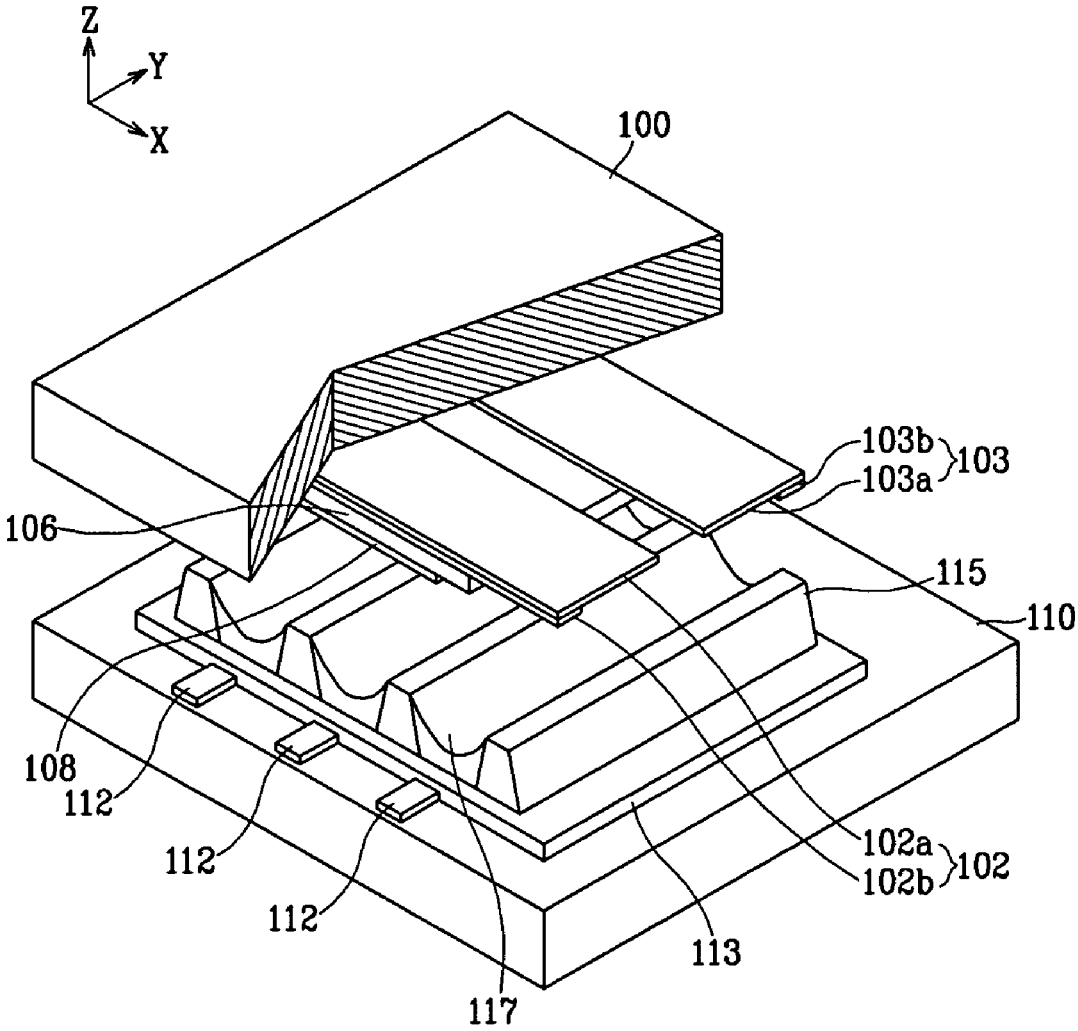
FIG. 17 is a partial sectional perspective view of a PDP.

FIG. 16 is a partial plan view of a PDP according to a tenth embodiment of the present invention.

As shown in FIG. 16, igniter electrodes 61 and 62 may be alternately connected to the pair of transparent electrodes 45*a* and 46*a* facing each other, like the structure related to the eighth embodiment of the present invention. Additionally, the igniter electrodes 61 and 62 may be alternately arranged per two barrier ribs 17 for forming the discharge cells 23R, 23G, and 23B, not per each barrier rib 17. However, in this embodiment, as shown in FIG. 9, the igniter electrodes 61 and 62 connected to the transparent electrodes 45*a* and 46*a* may be arranged in pairs while facing each other. The igniter electrodes 61 and 62 may have extensions 61*a* and 62*a* extending from portions of the transparent electrodes placed over the barrier rib 17 along the barrier rib 17, and protrusions 61*b* and 62*b* branched from the ends of the extensions 61*a* and 62*a* and protruded toward the inside of the pair of discharge cell neighbors 23R, 23G, and 23B in the direction of the bus electrodes 45*b* and 46*b*.

As described above, with the inventive PDP, igniter electrodes may be formed between a pair of discharge sustain electrodes (the scan electrode and the sustain electrode) facing each other to lower the discharge firing voltage Vf, thereby obtaining stability in the sustain discharge. Furthermore, the space charges formed by the discharge at the igniter electrodes may be used in sustaining the discharge in the relatively long-gapped main discharge path, thereby serving to enhance the discharge efficiency.

The extension of the igniter electrode may be placed over the barrier rib to confine the discharge current, thereby broadening the life span of the igniter electrode, and reducing the power consumption.

In addition, the extension of the igniter electrode may have higher resistance than the protrusion so that it may reduce the discharge electric current without a loss of discharge voltage, and reduce the power consumption more than before.

Although several embodiments of the present invention have been described in detail hereinabove, it should be clearly understood that many variations and/or modifications of the basic inventive concept herein taught that may appear to those skilled in the art will still fall within the spirit and scope of the present invention, as defined in the appended claims.

What is claimed is:

1. A plasma display panel, comprising:

a plurality of discharge cells arranged between a first substrate and a second substrate, wherein each of the plurality of the discharge cells comprises:

a first barrier rib to define the discharge cell;

a first discharge sustain electrode extending to cross with the first barrier rib and comprising a first protrusion electrode that extends into the discharge cell;

a second discharge sustain electrode extending substantially parallel with the first discharge sustain electrode and comprising a second protrusion electrode that extends into the discharge cell; and an igniter electrode extending from the first discharge sustain electrode along the first barrier rib and protruding into the discharge cell between the first protrusion electrode and the second protrusion electrode.

2. The plasma display panel of claim 1, wherein the igniter electrode comprises an extension that extends from the first discharge sustain electrode along the first barrier rib, and a protrusion that branches from the extension to protrude into adjacent discharge cells.

3. The plasma display panel of claim 2, wherein the extension has a higher resistance than the protrusion.

4. The plasma display panel of claim 1, further comprising:

a plurality of address electrodes arranged substantially orthogonal to the first discharge sustain electrode;

wherein the first discharge sustain electrode further comprises a first bus electrode, the first protrusion electrode extending from the first bus electrode into the discharge cell.

5. The plasma display panel of claim 4, wherein the igniter electrode extends from the first bus electrode and protrudes toward the inside of the discharge cell in a direction substantially parallel with the first bus electrode.

6. The plasma display panel of claim 4, wherein the igniter electrode comprises an extension that extends from the first bus electrode along the first barrier rib and a protrusion that branches from the extension to extend into adjacent discharge cells in a direction substantially parallel with the first bus electrode.

7. The plasma display panel of claim 6, wherein the extension has a length greater than the first protrusion electrode.

8. The plasma display panel of claim 7, wherein the extension has a higher resistance than the protrusion.

9. The plasma display panel of claim 4, wherein the igniter electrode extends from the first bus electrode.

10. The plasma display panel of claim 4, wherein the igniter electrode protrudes into the discharge cell in a direction substantially parallel with the first bus electrode.

11. The plasma display panel of claim 4, wherein the first protrusion electrode is transparent.

12. The plasma display panel of claim 4, wherein the protrusion electrodes are metallic electrodes having a mesial aperture.

13. The plasma display panel of claim 4, wherein the first protrusion electrode is metallic.

14. The plasma display panel of claim 2, wherein the extension is an indium Tin Oxide (ITO) electrode and the protrusion is a metallic electrode.

15. The plasma display panel of claim 1, wherein the igniter electrode is transparent.

16. The plasma display panel of claim 1, wherein the igniter electrode is metallic.

17. The plasma display panel of claim 1, wherein the first protrusion electrode and the second protrusion electrode comprise transparent electrodes that extend in a direction parallel with an address electrode arranged between the first barrier rib and a second barrier rib, and bus electrodes extend along a periphery of the transparent electrodes.

18. The plasma display panel of claim 17, wherein the igniter electrodes extend from portions of the transparent electrodes placed over barrier ribs, and protrude toward the inside of the discharge cells.

19. The plasma display panel of claim 17, wherein the igniter electrode extends from the transparent electrode, and branches from the extension while protruding toward the inside of the cell.

20. The plasma display panel of claim 17, wherein the igniter electrode extends from at least one of a pair of facing transparent electrodes.

21. The plasma display panel of claim 17, wherein the igniter electrode is arranged corresponding to the first barrier rib and extends in the direction of the transparent electrodes.

* * * * *